United States Patent [19]

Beretta

[11] Patent Number: 4,811,509

[45] Date of Patent: Mar. 14, 1989

[54] MONOTRIGGER MECHANISM FOR TRAPSHOOTING GUNS

[75] Inventor: Pier G. Beretta, Gardone V.T., Italy

[73] Assignee: Fabbrica D'Armi P. Beretta S.p.A., Italy

[21] Appl. No.: 116,654

[22] Filed: Nov. 3, 1987

[51] Int. Cl.[4] ..... F41C 19/18

[52] U.S. Cl. ..... 42/42.01; 42/69.01

[58] Field of Search ..... 42/42.01, 41, 69.01

[56] References Cited

U.S. PATENT DOCUMENTS

| | | | |
|---|---|---|---|
| 3,899,845 | 8/1975 | Wild et al. | 42/69.02 |
| 4,403,436 | 9/1983 | Jennie | 42/42.01 |
| 4,646,457 | 3/1987 | Verney-Carron | 42/41 |
| 4,662,098 | 5/1987 | Timari | 42/69.01 |
| 4,667,429 | 5/1987 | Perazzi | 42/69.01 |

*Primary Examiner*—Deborah L. Kyle
*Assistant Examiner*—Richard W. Wendtland
*Attorney, Agent, or Firm*—McGlew & Tuttle

[57] ABSTRACT

A monotrigger mechanism is disclosed for double-barrelled guns, such as trapshooting guns, in which guns the hammers, their respective springs, levers, trigger and pendular mass are all premounted on an underguard. The trigger is longitudinally positionable and the coupling of the underguard is effected by means of an oscillating lever controlled by the safety sled, which is mounted on the upper portion of the breech of the gun and interacts with the trigger.

2 Claims, 6 Drawing Sheets

MONOTRIGGER MECHANISM FOR TRAPSHOOTING GUNS

RELATED APPLICATIONS

Copending patent application of Pier Giuseppe Beretta, based on Italian patent application No. 5117-A/87 filed on Feb 23, 1987, for a "Device For Rapidly Engaging And Disengaging The Trigger Mechanism In The Breech Of A Gun".

FIELD OF THE INVENTION

The present invention relates to trapshooting guns, in general, and, more particularly, to a monotrigger mechanism for guns, in which the hammers, their springs, levers, trigger and other members are all premounted on an underguard of the gun.

BACKGROUND OF THE INVENTION

In the field of double-barrelled trapshooting guns and hunting guns with the barrels positioned either side by side or one over the other, there are already known several types of trigger mechanisms. These mechanisms comprise, generally, a pair of hammers, corresponding to the two barrels of the gun, and a single trigger for controlling the successive disengagement of the two hammers. Each conventional trigger mechanism has its own characteristic features and its members are mounted on an underguard which is applicable to the lower portion of the breech of the gun, in correspondence with a suitable opening or slit. This allows the assembling and disassembling, as a unit, of the trigger mechanism.

However, the mounting and dismounting of the trigger mechanism, in practice, is neither simple nor user friendly, as one would indeed desire. Furthermore, the trigger of these mechanisms cannot be positioned longitudinally, in answer to the user's needs, without avoiding the possibility of an uncontrolled displacement or involuntary opening of the trigger itself.

BRIEF DESCRIPTION OF THE INVENTION

The present invention is instead addressed to a monotrigger mechanism, particularly for trapshooting guns, according to claim 1, and provides a reliable and safe mechanism.

It is, therefore, an object of the invention to provide a monotrigger mechanism that offers a trigger with variable and controllable positioning and an underguard that can be rapidly blocked and unblocked in the breech of the gun, through simple engaging means connected to and workable by the safety member of the gun.

THE DRAWINGS

Greater details of the invention will become more evident from the following detailed embodiments thereof, with reference to the accompanying drawings, in which.

DETAILED DESCRIPTION OF THE INVENTION

Figure 1:
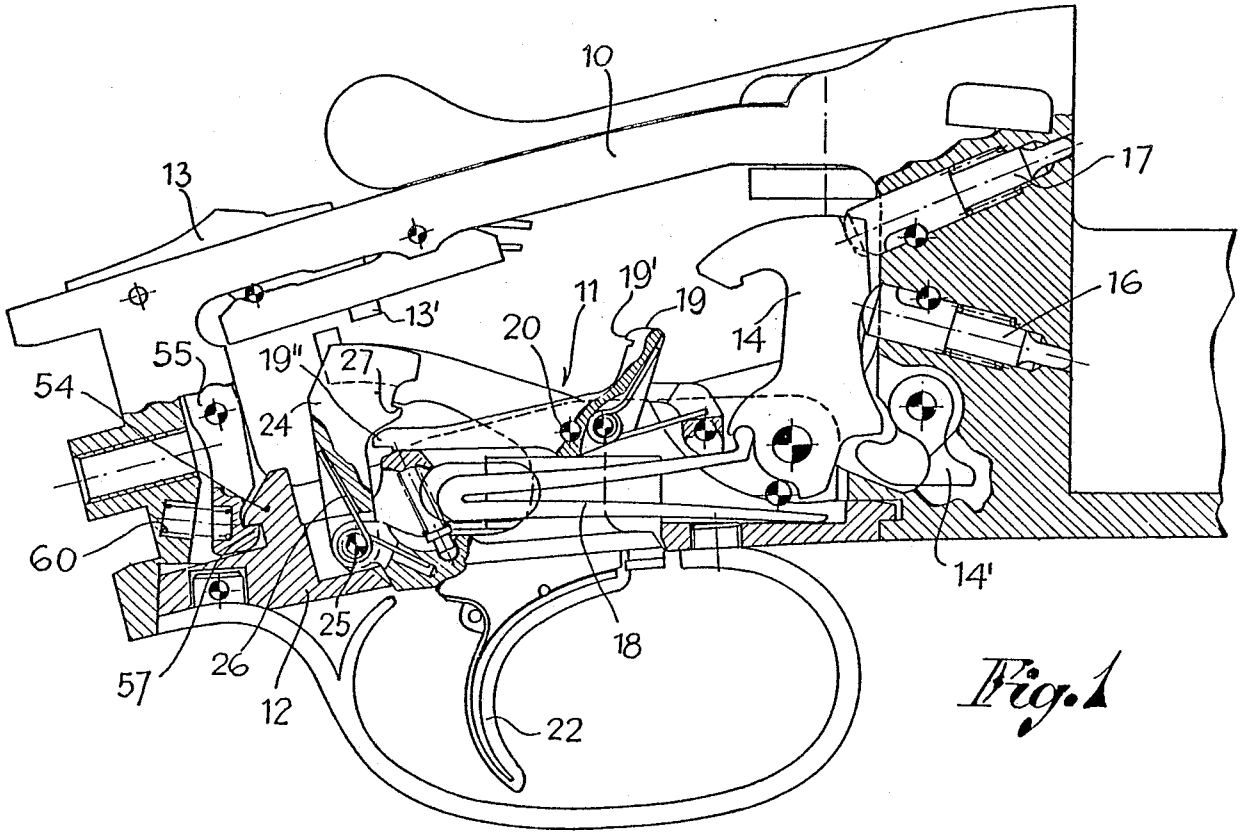
FIG. 1 is a partial, sectional view of the trigger mechanism with elements in the rest position.

With reference now to the accompanying drawings, numeral 10 represents, in general, the breech of the gun. In the breech, there is mounted a trigger mechanism 11, the member elements of which are premounted on an underguard 12, which is in turn applicable to the lower portion of the breech. In the upper portion of the breech, instead, there is mounted a safety sled 13 that has an arresting or blocking portion 13' facing toward the trigger mechanism and intended to prevent, when in the position of safety, the functioning or operation of the trigger mechanism itself.

The trigger mechanism 11 comprises two hammers 14-15, that is, a right one (14) and a left one (15). Both hammers are pivoting on the underguard 12 and are intended to act against the firing pins 16-17, corresponding to the two barrels (positioned side by side or one over the other) of the gun (not shown in the drawings).

Hammer 14 is urged by a cross-bow spring 18 and is engaged in cocked position by a spring-loaded lever 19. Lever 19 is pivotally mounted on a pin 20,attached to the underguard 12 and having, on one side, a tooth 19' for interaction with the hammer 14, and, on the other side, a beak 19" faced toward the rear. Similarly, hammer 15 is urged by a cross-bow spring 18' and is engaged in cocked position by a spring-loaded lever 21. Lever 21 is also mounted on the pin 20 and has a tooth 21' interacting with the hammer 15 and a rear beak 21".

The displacement of the hammers 14–15 in cocked position is determined by the corresponding levers 14'–15', controlled, in manner known per se, by the opening of the barrels. Conversely, the disengagement of the hammers for firing is controlled by a single trigger 22, pivoting at 20 on the underguard 12 and intended to act, firstly, on the lever 19 of the right hammer 14 and, subsequently, on the lever 21 of the left hammer 15, through a pendular mass 24 positioned behind the levers 19–21. The pendular mass 24 is pivoting underneath, at 25, on the trigger 22 and is urged by a spring 26 which keeps the mass normally displaced toward the rear beaks 19"–21" of the levers 19–21. The pendular mass is provided, furthermore, with a pair of shoulders 27–28 so positioned as to interact, at subsequent times, the first with the rear beak 19" of the lever 19 of the right hammer 14, and the second with the rear beak 21" of the lever 21 of the left hammer 15, for the disengagement of the hammers, in accordance with the sequence described hereabove.

Figure 2:
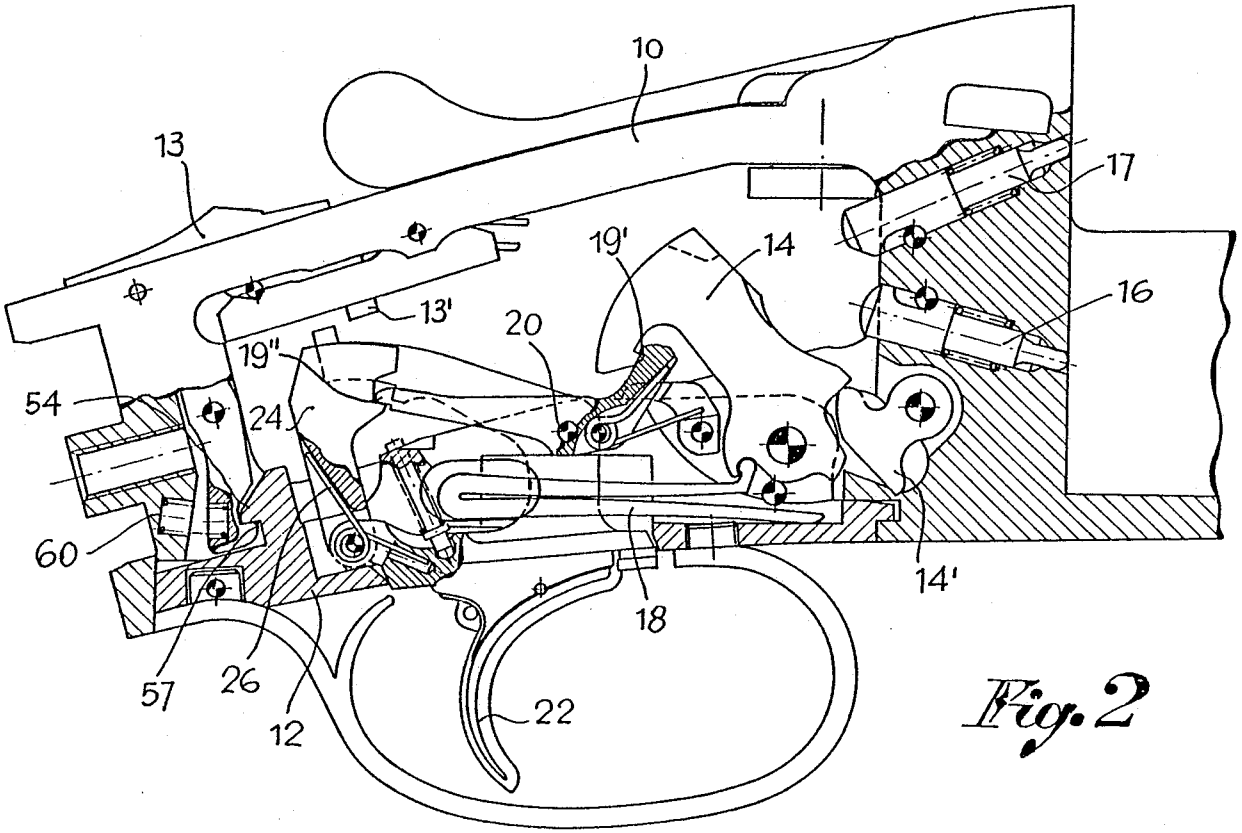
FIG. 2 is an analogous view of the trigger mechanism with the hammers in cocked position.
Figure 3:
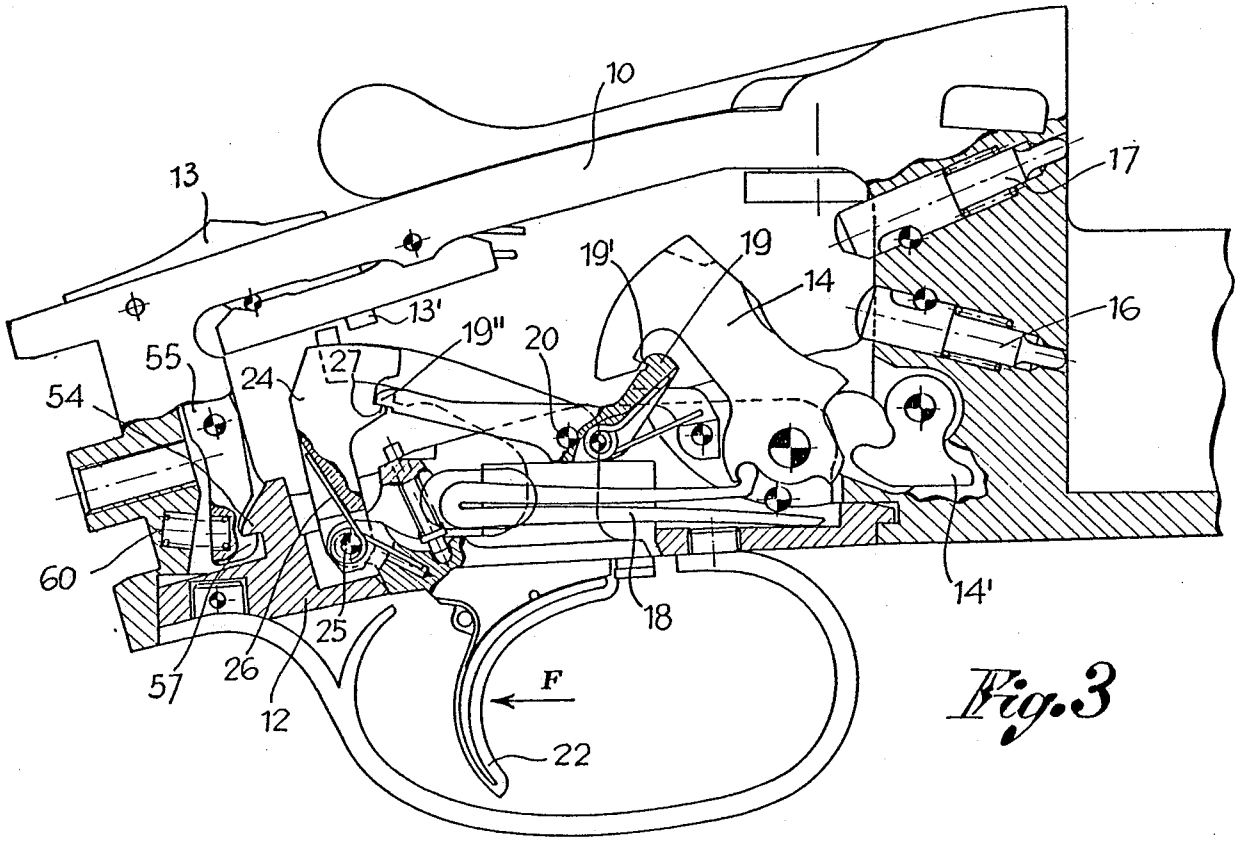
FIG. 3 is a view analogous to FIG. 2, showing the right hammer in phase of disengagement.

In fact, starting from the cocked position illustrated in FIG. 2 of the drawings, to a first activation of the trigger 22 (see arrow F in FIG. 3) corresponds the rising of the pendular mass 24 with consequent displacement of the lever 19 and the disengagement of the right hammer 14 for the firing of a shell in one barrel. The recoil and counterrecoil action which follows determines the detachment of the shoulder 27 of the pendular mass 24 from the beak 19"; of the lever 19. This, then, allows the pendular mass 24 to interact, through the other shoulder member 28, with the beak 21" of the other lever 21, as soon as the trigger 22 is released after the firing of the first shell.

Figure 4:
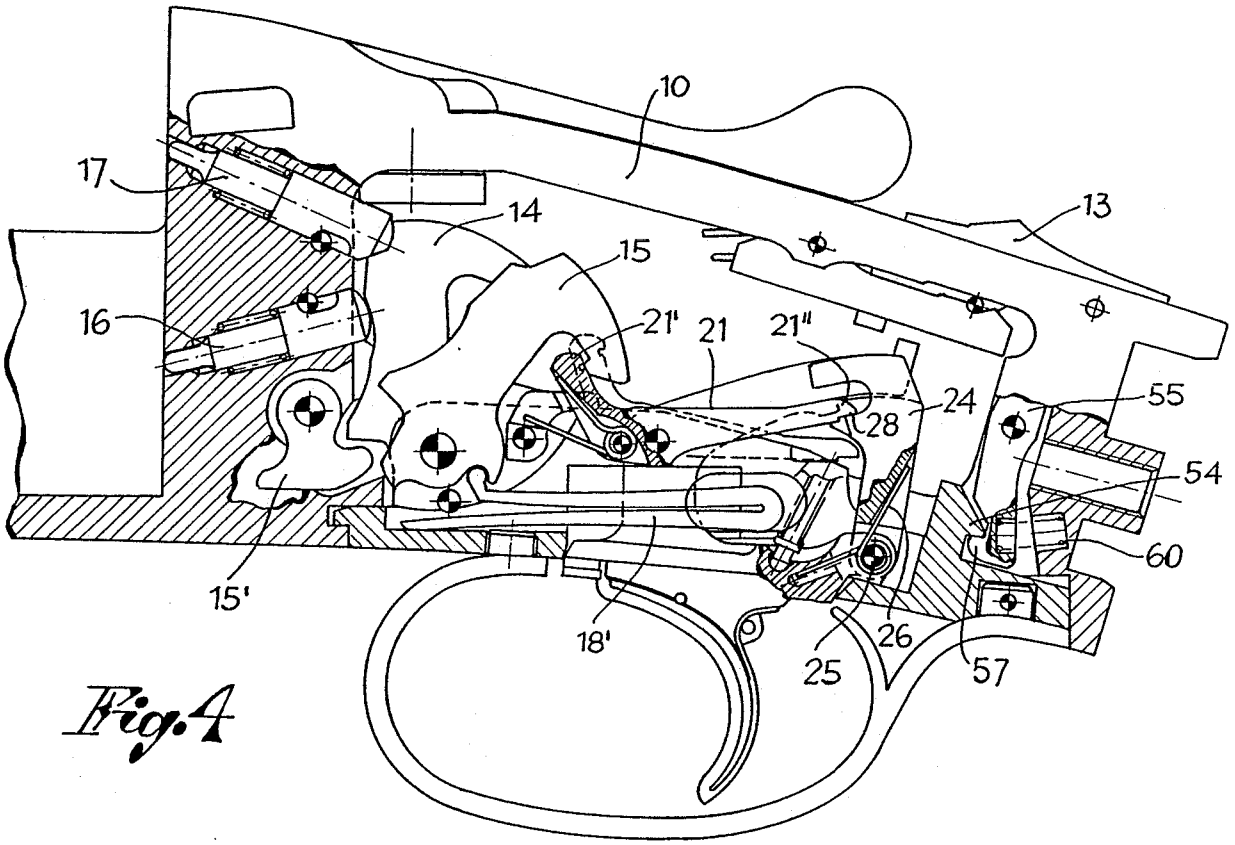
FIG. 4 is a partial, sectional view of the condition of engagement of the left hammer (after the disengagement of the right hammer)
Figure 5:
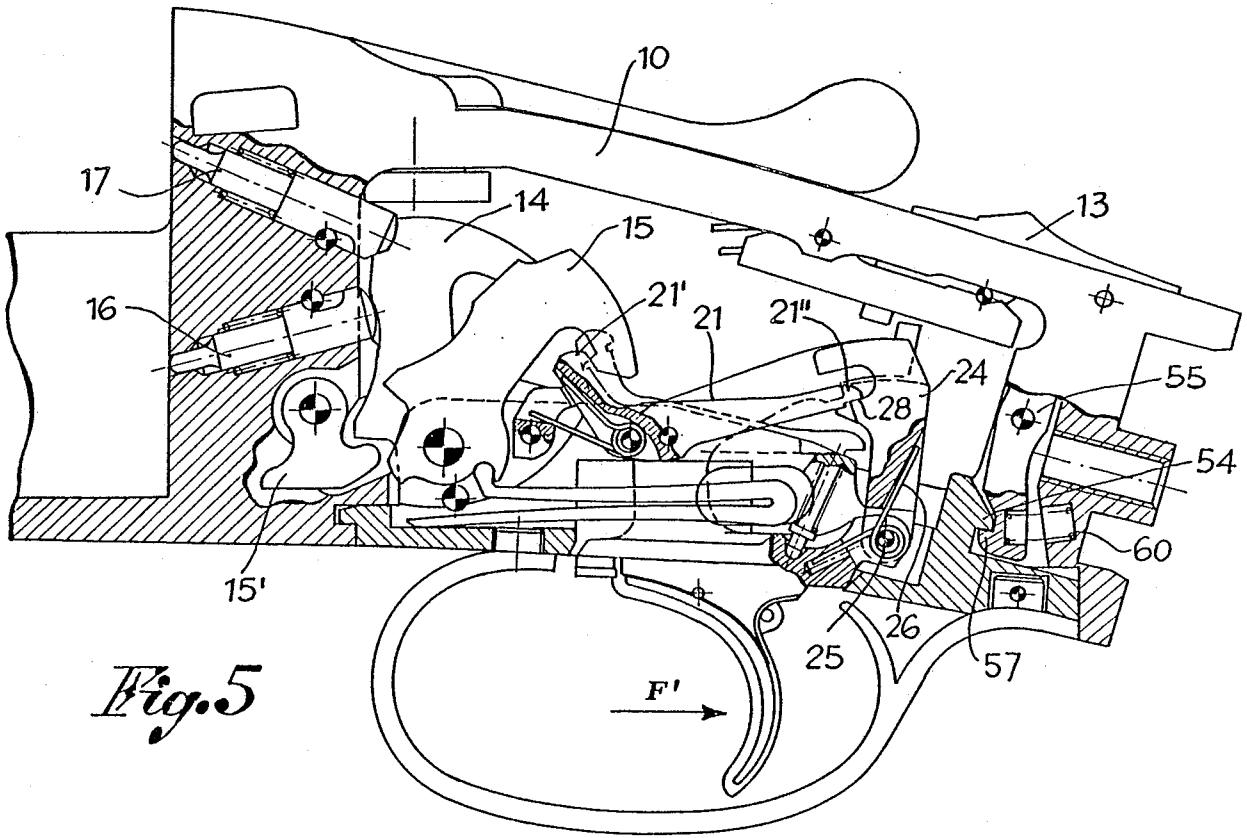
FIG. 5 is a view analogous to FIG. 4, showing the left hammer in phase of disengagement.

One has, thusly, the condition illustrated in FIG. 4. Starting from this condition, it is possible to disengage the left hammer 15, in order to fire the shell in the other barrel of the gun. This is done by acting again on the trigger, as indicated by arrow F' in FIG. 5.

Advantageously, trigger 22 of the trigger mechanism 11 is position-controlled and, for this purpose, it is coupled with a lever support 31 that constitutes that portion of the trigger which pivots, at 20, on the underguard. The underguard carries at its rear the pendular mass 24 and extends upwardly with an appendix 32 intended to cooperate with the arresting portion 13' of the safety sled 13 mounted in the breech 10, in the setting of the gun in the position of safety.

Figure 6:
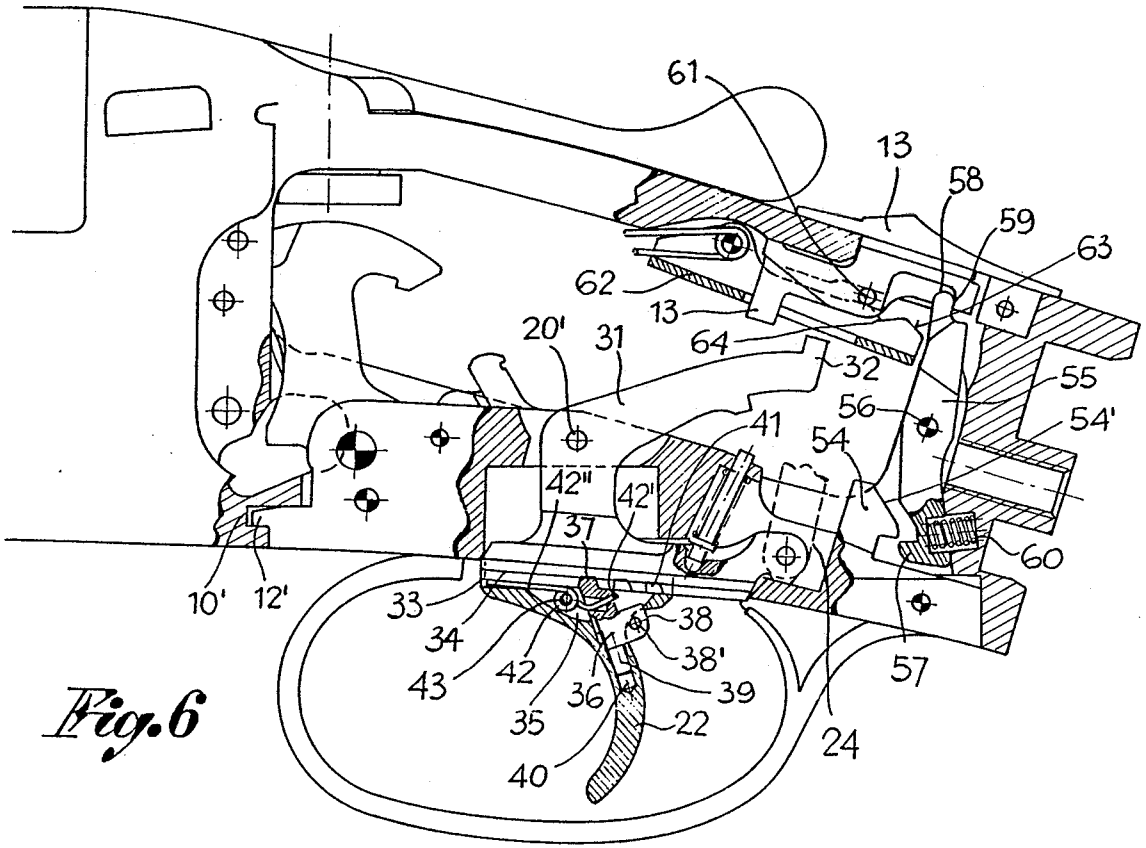
FIG. 6 is a sectional view of the trigger and of the engagement means of the trigger mechanism in the breech.

More precisely, as clearly shown in FIG. 6, the trigger 22 is provided in its upper part with a guide seat 33, shaped as the tail of a dove, or as a T or the like,. Guide seat 33 is intended to mate with a corresponding guide portion 34 longitudinally provided in the lower part of the support 31. In the upper portion of the trigger 22, there is also provided a cavity 35 open toward the support and toward the rear of the trigger proper. In this cavity 35, there is displaceably mounted an arresting or blocking latch 36, which has, in its upper part, a wedge-like tooth 37 and, in its rear part, a maneuver member portion 38. The blocking latch 36 is, further, provided with a peg or stem 39, guided into an opening 40 provided in the trigger 22 at the base of the cavity 35.

The wedge-like tooth 37 of the blocking latch 36 is facing toward and cooperates selectively with any of a plurality of arresting notches 41 provided on the lower surface of the support 31. The notches are spaced one from another longitudinally along the support 31, each having a shape corresponding to and opposite to the wedge-like shape of the tooth 37 of the blocking latch 36. The maneuver member portion 38 of the blocking latch 36 protrudes from the rear opening of the cavity 35 of the trigger 22 and is provided with a transverse aperture 38', into which a small rod or equivalent member may be inserted for controlling the latch.

The latch 36 is urged by a spring 42, for example a torque spring, mounted on a spine 43 and having a first terminal 42' attached to the latch 36 and a second terminal 42'' blocked between the upper surface of the trigger and the base of the support 31.

The spring 42 is preloaded, in order to keep the blocking latch normally displaced toward the support 31. The tooth 37 is engaged with one of the arresting notches 41. In order to change the position of the trigger, it is therefore sufficient to insert the small rod in the opening 38' of the maneuver member portion 38 of the blocking latch 36, so as to displace the latter to a point where its tooth is disengaged from the notch in which it was positioned. This allows, then, the displacement of the trigger with respect to the support until the tooth is carried to engage another notch, thus arriving at another position of the trigger with respect to the previous, initial position.

To apply the trigger mechanism 11 to the breech 10, the underguard 12 is provided in the front thereof with a tongue 12' which is intended to engage within a complementary seat 10' provided in the breech itself. At the rear, the underguard 12 is integral with a hook 54 which faces toward the interior of the breech 10, behind the trigger mechanism 11. The hook 54 has a bevelled head 54'.

In the breech 10, between the hook 54 and the safety sled 13, there is provided an lever 55 pivotally mounted on an intermediate transverse pin 56. Lever 55 has, on one hand, a tooth 57 for engaging the hook 54 integral with the underguard 12 and, on the other hand, a terminal 58 for interaction with a shoulder 59 provided at the base of the safety sled 13. The lever 55 is, furthermore, urged by a preloaded spring 60 acting so as to keep its tooth 57 normally engaged with the hook 54 and its terminal 58 displaced toward the shoulder 59 of the safety sled 13.

In practice, the underguard 12, complete with the trigger mechanism 11, is mounted on and attached to the breech 10 by, firstly, engaging the front tongue 12' in the complementary seat 10' and, subsequently, pushing the mechanism in the breech until the hook 54 and the tooth 57 of the lever 55 are reciprocally engaged. The coupling is aided by the bevelled head 54' of the hook 54 and by the action of the spring 60 acting on the lever 55 without the need of any other operation.

The safety sled 13 is provided with a peg 61 that interacts with a spring-loaded pusher 62, which has a ramp 63 defining with the peg 61 the position of safety and, furthermore, has an intermediate cavity 64 which defines, again with the said peg 61, the position of firing, that is to say, the position of operation of the gun.

In the position of safety, the sled 13 is fully displaced to the rear, so that its arresting portion 13' interferes with the appendix 32 of the trigger 22, thus preventing the operation or functioning of the trigger mechanism 11. At the same time, the shoulder 59 is moved away from the terminal 58 of the lever 55. In the position of firing, the safety sled 13 is arrested in an intermediate position due to the positioning of its peg 51 in the cavity 64 of the spring-loaded pusher 62. The shoulder 59 is, thus, adjacent to the terminal 58 of the lever 55, without however, altering the position of the latter. In either position, of safety or of firing, the sled 13 has, therefore, no influence whatever upon the oscillating lever 55, so that the condition of engagement and attachment of the trigger mechanism in the breech 10 is not altered when one passes from one condition to the other.

The safety sled 13 is, however, displaceable manually toward the front and beyond the position of firing, in order to disengage the trigger mechanism 11, when it is necessary to remove it from the breech 10. As a result of this displacement of the sled 13, the shoulder 59 acts against the terminal 58 of the lever 55, displacing the latter in opposition to the action of the spring 60. The tooth 57 of the lever 55 is, thus, moved away and disengaged from the hook of the underguard 12, in order to allow the removal of the trigger mechanism. When the manual operation has ended, the spring 60 returns the lever 55 and, through the lever, the safety sled 13 to the position of firing, or to the position which allows the successive mounting and blocking of the trigger mechanism.

What is claimed is:

1. A monotrigger mechanism for breeches of double-barrelled, trap shooting guns, which comprises an underguard; means for coupling the underguard to and detaching the underguard from the breech; two hammers pivoted on said underguard; said hammers being biassed in a firing direction by respective cross-bow springs and being coordinated with respective firing pins corresponding to the respective barrels of the gun; a pair of levers pivoted on said underguard respective levers being arranged to arrest respective hammers in a cocked position; a trigger pivoted on said underguard and attached to a pendular mass for the separate control of the pivotal displacement of the respective levers in a predetermined sequence thereby to disengage the respective hammers according to the sequence; said pendular mass having a pair of shoulders spaced apart from each other for sequential engagement with respective levers, following a first and a second action of said trigger; a lever support pivotally mounted on said underguard for actuating said pivoted levers through said pendular mass; a plurality of arresting notches provided on said lever support in spaced apart relation in the longitudinal direction of the gun; means mounting said trigger on the lever support for sliding movement in the longitudinal direction of the gun; a blocking latch on said trigger having a tooth selectively engageable with respective of said notches to locate the trigger in different longitudinal positions; and a pre-loaded retaining spring biassing said tooth into engagement with respective notches, said blocking latch being seated in a cavity provided in an upper part of said trigger; said latch having a maneuver portion thereon, protruding from said cavity; said maneuver portion having an opening for receiving a rod by which the tooth can be withdrawn from a notch against the action of said biassing spring to permit adjustment of the longitudinal position of the trigger by sliding movement of the trigger along the longitudinal access.

2. A monotrigger mechanism according to claim 1 wherein the means mounting the trigger on the lever support comprises a guide seat, and the lever support is formed with a guide portion which mates with the guide seat dove-tail fashion, the biasing spring being a tension spring which is wound around a spine provided in the trigger cavity in preloaded condition with one end of the tension spring extending longitudinally trapped between the guide seat and the trigger support and the other end of the spring retained in the latch.

* * * * *

UNITED STATES PATENT AND TRADEMARK OFFICE

CERTIFICATE OF CORRECTION

PATENT NO. : 4,811,509

DATED : March 14, 1989

INVENTOR(S) : Pier G. Beretta

It is certified that error appears in the above-identified patent and that said Letters Patent is hereby corrected as shown below:

On the title page Insert

--(30) Foreign Application Priority data

February 3, 1987 Italy 5116-A/87--.

Signed and Sealed this

Eighth Day of May, 1990

*Attest:*

HARRY F. MANBECK, JR.

*Attesting Officer*

*Commissioner of Patents and Trademarks*